US005686382A

United States Patent [19]

Suzuki et al.

[11] Patent Number: 5,686,382

[45] Date of Patent: Nov. 11, 1997

[54] THERMAL RECORDING STRUCTURE AND METHOD

[75] Inventors: Akira Suzuki, Mishima; Masaki Yoshino, Yokohama; Yoshihiko Hotta; Hiroyuki Uemura, both of Mishima, all of Japan

[73] Assignee: Ricoh Company, Ltd., Tokyo, Japan

[21] Appl. No.: 556,021

[22] Filed: Nov. 13, 1995

[30] Foreign Application Priority Data

Nov. 11, 1994 [JP] Japan ..... 6-303092

[51] Int. Cl.[6] ..... B41M 5/035; B41M 5/38

[52] U.S. Cl. ..... 503/201; 428/195; 428/913; 428/914; 503/227

[58] Field of Search ..... 8/471; 428/195, 428/913, 914; 503/227, 201

[56] References Cited

U.S. PATENT DOCUMENTS

| | | | |
|---|---|---|---|
| 4,847,144 | 7/1989 | Suzuki et al. | 428/321.5 |
| 4,880,768 | 11/1989 | Mochizuki et al. | 503/227 |
| 5,019,550 | 5/1991 | Suzuki et al. | 503/227 |
| 5,039,369 | 8/1991 | Suzuki et al. | 156/234 |
| 5,049,538 | 9/1991 | Mochizuki et al. | 503/227 |
| 5,087,601 | 2/1992 | Hotta et al. | 503/200 |
| 5,144,334 | 9/1992 | Suzuki et al. | 346/1.1 |
| 5,198,061 | 3/1993 | Suzuki et al. | 156/234 |
| 5,278,128 | 1/1994 | Hotta et al. | 503/207 |
| 5,302,575 | 4/1994 | Nogawa et al. | 503/227 |
| 5,314,861 | 5/1994 | Morohoshi et al. | 503/227 |
| 5,321,239 | 6/1994 | Masubushi et al. | 235/380 |
| 5,448,065 | 9/1995 | Masubuchi et al. | 250/316.1 |
| 5,472,931 | 12/1995 | Morohoshi et al. | 503/227 |
| 5,489,494 | 2/1996 | Hotta et al. | 430/19 |

*Primary Examiner*—Bruce H. Hess

*Attorney, Agent, or Firm*—Oblon, Spivak, McClelland, Maier & Neustadt, P.C.

[57] ABSTRACT

Thermal recording structure and a method of thermal recording wherein a desired sublimation dye image is formed on an information recording medium provided with a thermal recording layer having a sublimation dye accepting function on at least one surface of a base substrate. The transparency of the thermal recording layer is reversible depending upon temperature to which the medium is heated. At least the sublimation dye image portion of the medium is heated to a temperature sufficient to reverse the transparency of the transfer image.

19 Claims, 8 Drawing Sheets

THERMAL RECORDING STRUCTURE AND METHOD

BACKGROUND OF THE INVENTION

1. Field of the Invention

This invention relates to a thermal recording structure and method applied to an information recording medium which enables the temporary and reversible display of information on the structure.

2. Description of the Related Art

Recently, information related technology such as an information network system (INS) which is a high-level information communication system and a value-added network (VAN) has been rapidly developed and the value of information has been enhanced. However, many current systems require a separate hard copy for displaying the information because a method of both transmitting information and disclosing display function, e.g., storage and display of information, are not provided in the information processing related equipment. For example, when cash is withdrawn or deposited by use of a cash card of the type widely utilized by a large number of persons at present, a hard copy on which balance information of a user's deposit is printed is separately outputted to inform the user of the balance information. When a credit or debit card is used, a hard copy is very often required separately because the cards are not provided with a displaying function. It is desired that such cards be provided with a display function.

Therefore, as one means for realizing such a desire, it has been suggested to produce a multifunctional card provided with a display function by accommodating a liquid crystal display and a thin type of battery in card such as in instant cash (IC) card. Such units may also function as a pocket calculator. However, problems relating to the availability of such a card, including the requirements of a battery and considerably high cost of the card were left unsolved.

The applicant of the present invention, in Japanese Laid-open Patent Publication No. H5-193256/1993, proposed a recording medium which enabled sublimation printing on a heat reversible recording material. The recording medium permitted an information recording method which could provide required information at a low cost, wherein information could be displayed or erased readily, and as a result the information could be displayed repeatedly. A display image with a striking contrast (high contrast) not erased readily by friction could be obtained, and a clear full-dyed image could be provided.

If thermal sublimation printing is performed on a transparent surface of the above-described recording medium, which enables both heat reverse printing and sublimation printing as disclosed in Japanese Laid-open Patent Publication No. H5-193256/1993, a clear dye image can be formed. However, the image in a portion which receives high printing energy is sometimes opaque in white. White opaque unevenness is sometimes formed on a transparent dye image in a portion with low printing energy. As a result a problem that dye image performance is deteriorated occurs. The white opaque surface of the above-described recording media becomes transparent due to low printing energy and such white opaque unevenness is sometimes formed on it.

In the meantime, there is a problem that many substances adhere to the surface of a recording layer. Moreover, dye contained in a transferred sublimation dye image is readily sublimated into the air as time elapses, and the density of the transferred dye image is deteriorated.

The invention herein may be applied to a system wherein, for example as a first step, a picture of a persons face comprising a sublimation image is printed to form an ID card, then the picture is handed to the person, and as a second step, a variety of information is rewritten by heat reversible recording. Therefore, the sublimation image formation process of the invention has a step which includes a heating process for removing opaqueness and uneven transparency and fixing the sublimation image. A clear full dye image is formed and a sublimation image with high-grade fixing is provided.

SUMMARY OF THE INVENTION

The object of the invention is to solve such, the problems mentioned above and to provide a thermal recording structure and method in which a high quality of display image can always be obtained.

According to the invention, 1) there is provided a thermal recording structure and a thermal recording method in which a sublimation dye image is formed and in which a thermal recording layer is heated after a sublimation dye image is formed. This is accomplished by providing the information recording medium with a thermal sublimation dye accepting function on at least one face of a base substrate and a thermal recording layer in which transparency is reversed depending on temperature;
2) there is also provided a thermal recording structure and method in which an overcoat layer is further provided to the information recording medium described in 1) above after a sublimation dye image is formed on the above-described medium;
3) there is further provided a thermal recording structure and method in which the above-described overcoat layer is formed on the information recording medium described in 2) above by either a thermal transfer method or an application method;
4) there is provided a thermal recording structure and method in which a thermally fused image is further formed on the information recording medium described in 1) above after a sublimation dye image is formed;
5) there is provided a thermal recording structure and method in which at least a thermal sublimation image portion described in 1) above is heated at a temperature at which the transparency is reversed or in the range of temperatures at which the above-described image portion becomes transparent;
6) there is provided a thermal recording structure and method in which at least a thermal sublimation image portion described in 1) above is heated at a temperature at which the transparency is reversed or in the range of temperatures at which the above-described image portion becomes opaque in white;
7) there is provided a thermal recording structure and method in which further then, a white opaque image (dye image) or a transparent image is printed on the information recording medium described in 1) to 6) above by heating directly; and
8) there is provided a thermal recording structure and method in which printing or erasure by heating the white opaque image (dye image) or a transparent image described in 7) above is repeated.
9) there is provided a medium according to 1) above wherein a thermal sublimation dye image portion of the thermal recording is substantially even in transparency throughout the area of the image.

As a result of research related to thermal recording methods, the inventors of the present invention show that a transparent clear dye image, without the problem of white opaque unevenness, is formed when the transparent surface of an information recording medium provided with both a thermal recording function by which transparency is reversed depending upon temperature and a sublimation transferred dye image accepting function is heated in the range of temperature at which the surface becomes transparent which is a characteristic of a heat reversible recording medium so as to perform thermal sublimation printing on the above-described transparent surface, and that in the meantime, a clear dye image without transparent unevenness is formed on the white opaque or white surface when the white opaque surface of the above-described information recording medium is heated in the range of temperatures at which the surface becomes opaque in white so as to perform thermal sublimation printing on the above-described white opaque surface. Furthermore, in the first step, sublimation dye, which is primarily present on the surface of the recording layer, is pushed inside the layer by sufficient heating, thereby forming a highly fixed sublimation dye image.

In a second step, after a sublimation dye image is formed in the first step, an overcoat layer is applied to serve as a protective layer for a thermal recording layer because printing is to be repeated by heat reversible recording hundreds times. It has been found that when the overcoat layer was used, no problems occur even though thermal printing using a thermal head was repeated 500 times or more. The overcoat layer also functions to enhance fixing of the sublimation image.

In a third step, the overcoat layer may be formed over the sublimation dye image using the same method as used in forming the sublimation dye image. The overcoat layer is readily formed by transferring transparent resin using a thermal transfer recording ribbon which is heated to melt and transfer the overcoat layer. Alternatively, the overcoat layer can be formed by a standard application method such as printing.

In a fourth step, an image with gradation as a dye picture is formed by forming a sublimation dye image, a character image is formed by melting and a clear image with high contrast is formed. Therefore, a full dye gradation image and a character image with high contrast can be obtained.

In a fifth step, a background portion in a portion in which a sublimation dye image is formed is transparentized by heating. The heating temperature is set to approximately 80° to 100° C. though the temperature depends upon a method for forming a heat reversible recording layer. A background portion can be transparentized evenly and an uneven portion can be removed.

In a sixth step, the heating temperature is set to approximately 100° C. or more and the background portion is opalized and becomes translucent.

The first step is described above, however, in a seventh step, other information is printed by heating to form an image with a sublimation dye image portion as a fixed image and the other portion as heat reversible recording portion. When the background is transparent, the other image is an opaque image and when the background is opaque, a transparent image is formed.

In an eighth step, the process in the seventh stop in which an opaque or transparent image printed in a heat reversible recording portion is erased and further printed is repeated. A rewritten (reversed) image which is a heat reversible recorded image is added to a fixed image which is a sublimation dye image and new information is rewritten properly.

In a ninth step, to keep the sublimation dye image portion of a medium which was formed in the first step, substantially even in transparency, a sublimation clear image without an opaque or transparent uneven portion must be formed. If the density of a portion in a sublimation dye image portion is in the range of approximately ±20% of the density in another portion, the sublimation dye image portion can be regarded as substantially even in transparency.

BRIEF DESCRIPTION OF THE DRAWINGS

A more complete appreciation of the present invention and many of the attendant advantages thereof will be readily obtained by reference to the following detailed description when considered in connection with the accompanying drawings.

FIG. 3(*b*) shows an information recording medium provided with a parting agent layer 7 on the reversible thermal recording layer 2' shown in FIG. 2.

FIG. 4(*b*) shows an Information recording medium provided with a dyed layer 4 or a light reflecting layer 5 immediately under the reversible thermal recording layer 2' shown in FIG. 4(*a*);

FIG. 5(*b*) shows an information recording medium provided with a dyed layer 4 or light reflecting layer 5 which is out of contact with the adhesive or pressure sensitive adhesive layer 11' in a portion thereof as shown in FIG. 5(*a*).

FIG. 6(*b*) shows an information recording medium provided with a magnetic recording layer 6 under a part of the base substrate 1 shown in FIG. 2.

FIG. 6(*c*) shows an information recording medium provided with a magnetic recording layer 6 between the reversible thermal recording layer 2 and the base substrate 1 shown in FIG. 2.

FIG. 6(*d*) shows an information recording medium provided with a dyed layer 4 or a light reflecting layer 5 and a magnetic recording layer 6 between the reversible thermal recording layer 2 and the base substrate 1 shown in FIG. 2.

FIG. 7(*b*) shows an information recording medium provided with the portion provided in FIG. 4(*b*) in a hollow portion of the base substrate 1 and an IC recorder 12 in another hollow portion of the base substrate 1.

FIG. 7(*c*) shows an information recording medium wherein the information recording medium shown in FIG. 2 is adhered on an IC card 13 by means of an adhesive or pressure sensitive adhesive layer 11'.

FIG. 7(*d*) shows an information recording medium provided with a dyed layer 4 or a light reflecting layer 5 in a portion out of contact with an adhesive or pressure sensitive adhesive layer 11' wherein a transparent base substrate 1" is used in place of the base substrate 1 shown in FIG. 7(*c*).

DESCRIPTION OF THE PREFERRED EMBODIMENTS

Referring to drawings, a concrete example of an information recording medium according to the invention will be described below.

Figure 2:
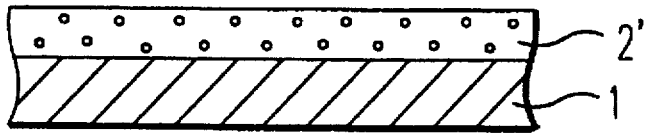
FIG. 2 shows an information recording medium provided with a reversible thermal recording layer 2' having a thermal sublimation dye accepting function superimposed on a base substrate 1.

FIG. 2 shows an information recording medium provided with a reversible thermal recording layer 2' with a thermal sublimation dye accepting function on a base substrate 1.

Figure 3A:
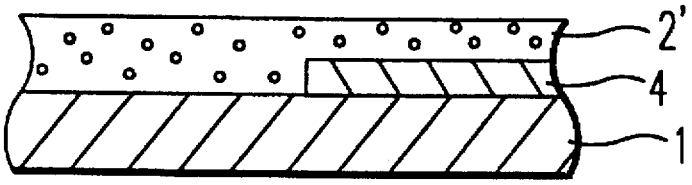
FIG. 3(*a*) shows an information recording medium provided with a dyed layer 4 or a light reflecting layer 5 immediately under the reversible thermal recording layer 2' shown in FIG. 2.
Figure 3B:
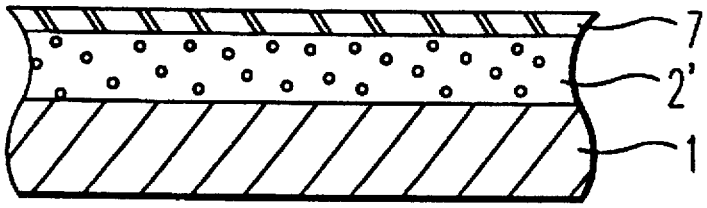

FIG. 3(*a*) shows an information recording medium provided with a dyed layer 4 or a light reflecting layer 5 immediately under the reversible thermal recording layer 2' shown in FIG. 2.

FIG. 3(*b*) shows an information recording medium provided with a parting agent layer 7 on the reversible thermal recording layer 2' shown in FIG. 2.

Figure 4A:
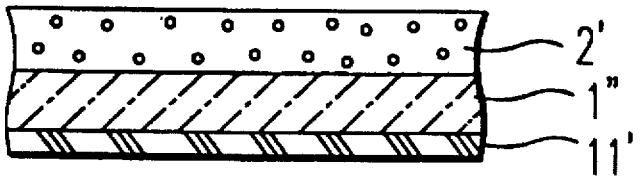
FIG. 4(*a*) shows an information recording medium provided with an adhesive or pressure sensitive adhesive layer 11' under a transparent base substrate 1" having a reversible thermal recording layer 2' thereon.
Figure 4B:
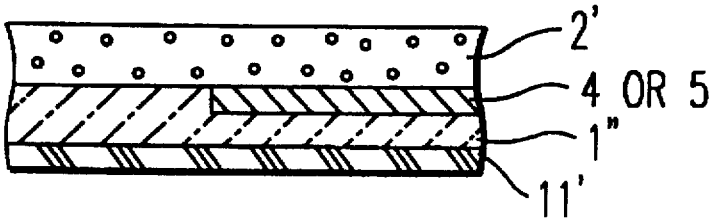

FIG. 4(*a*) shows an information recording medium provided with an adhesive or pressure sensitive adhesive layer 11' for sticking under a transparent base substrate 1" provided with a reversible thermal recording layer 2' thereon.

FIG. 4(*b*) shows an information recording medium provided with a dyed layer 4 or a light reflecting layer 5 immediately under the reversible thermal recording layer 2' shown in FIG. 4(*a*).

Figure 5A:
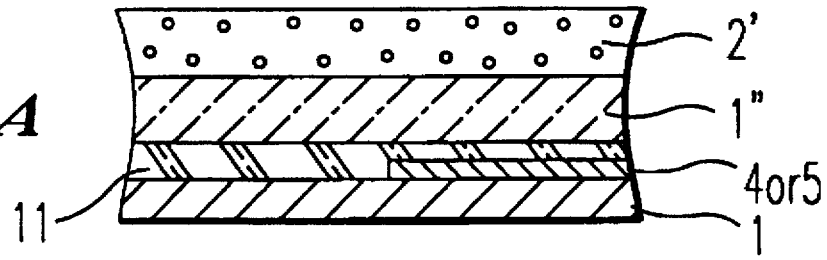
FIG. 5(*a*) shows an information recording medium wherein the information recording medium shown in FIG. 4(*b*) is adhered to a base substrate 1.
Figure 5B:
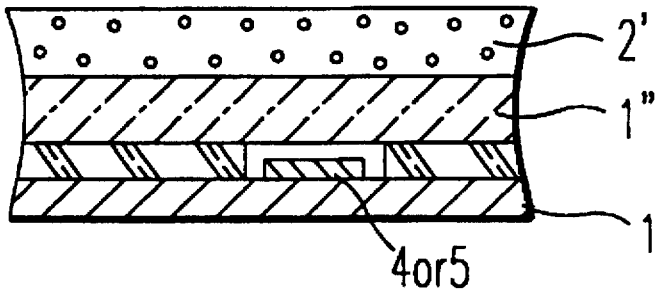
Figure 6A:
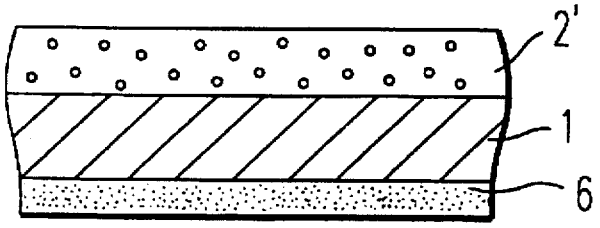
FIG. 6(*a*) shows an information recording medium provided with a magnetic recording layer 6 under the base substrate 1 shown in FIG. 2.
Figure 6B:
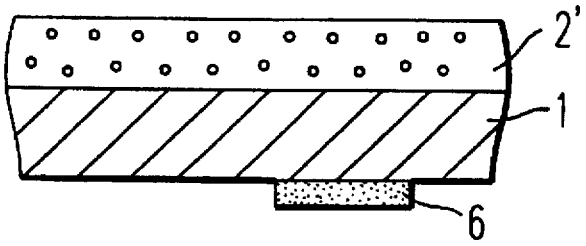
Figure 6C:
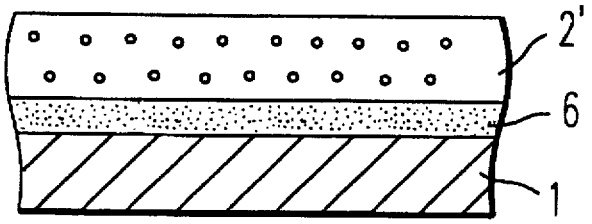
Figure 6D:
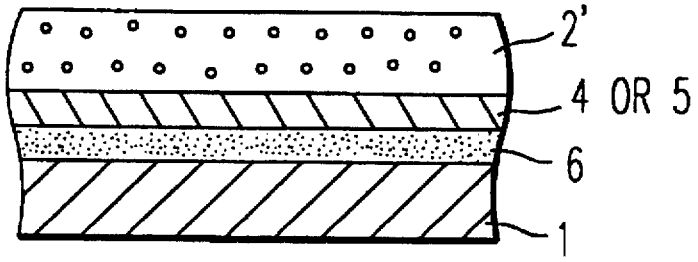
Figure 7A:
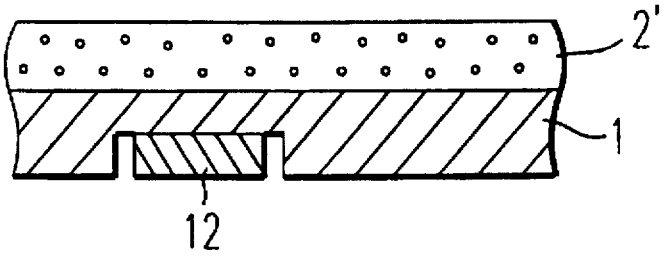
FIG. 7(*a*) shows an information recording medium provided with an IC recorder 12 in a hollow portion of the base substrate 1 shown in FIG. 2.
Figure 7B:
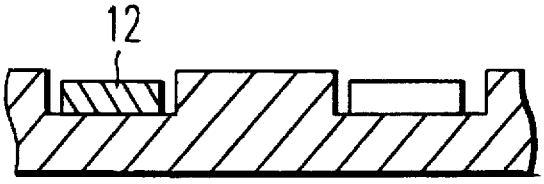
Figure 7C:
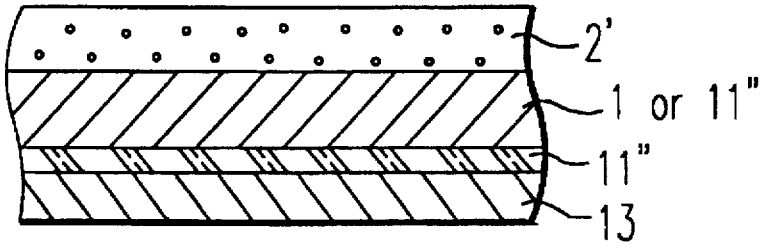
Figure 7D:
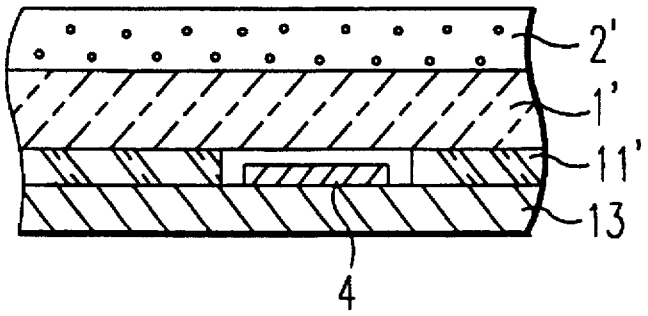

FIG. 5(*a*) shows an information recording medium wherein the information recording medium shown in FIG. 4(*b*) is adhered to a base substrate 1.

FIG. 5(*b*) shows an information recording medium provided with the dyed layer 4 or the light reflecting layer 5 shown in FIG. 5(*a*) in a portion out of contact with adhesive or pressure sensitive adhesive layer 11'.

FIG. 6(*a*) shows an information recording medium provided with a magnetic recording layer 6 under the base substrate 1 shown in FIG. 2. (An information recording medium shown in FIG. 3(*a*) or (*b*) may be used in place of that shown in FIG. 2.)

FIG. 6(*b*) shows an information recording medium provided with a magnetic recording layer 6 under a part of the base substrate shown in FIG. 2.

FIG. 6(*c*) shows an information recording medium provided with a magnetic recording layer 6 between the reversible thermal recording layer 2' and the base substrate 1 shown in FIG. 2.

FIG. 6(*d*) shows an Information recording medium provided with a dyed layer 4 or a light reflecting layer 5 and a magnetic recording layer 6 between the reversible thermal recording layer 2' and the base substrate 1 shown in FIG. 2.

FIG. 7(*a*) shows an information recording medium provided with an IC recorder 12 in a hollow portion of the base substrate 1 shown in FIG. 2.

FIG. 7(*b*) shows an, information recording medium provided with the portion provided in FIG. 4(*b*) in a hollow portion of a base substrate 1 and an IC recorder 12 in another hollow portion of the base substrate 1.

FIG. 7(*c*) shows an information recording medium wherein the information recording medium shown in FIG. 2 is adhered to an IC card 13 by means of adhesive or pressure sensitive adhesive layer 11'. However, a transparent base substrate 1" may be used in place of the base substrate 1.

FIG. 7(*d*) shows an information recording medium provided with a dyed layer 4 or a light reflecting layer 5 in a portion out of contact with adhesive or pressure sensitive adhesive layer 11'.

A dyed layer 4 or a light reflecting layer 5 is provided so that a display image formed on a reversible thermal recording layer 2' may be more visible.

Because the printing energy used in a thermal sublimation dye transfer recording method is twice or three times as high as that used in thermal reversible recording, a sticking phenomenon occurs between the above-described recording layer and an ink sheet sublimated by a thermal head, as a result a clear transferred sublimation dye image cannot be obtained. In an extreme case the above-described ink sheet may be broken. These problems can be solved by including a parting agent such as silicone grease in the thermal recording layer or by providing a parting agent layer on the recording layer.

As shown in FIGS. 4(*a*) and (*b*), an information recording medium which is provided with an adhesive layer or a pressure sensitive adhesive layer may be used as a label for creating an information recording medium.

For use as a resin base substrate constituting a reversible thermal recording layer of an information recording medium according to the invention, is has been found that vinyl chloride resin has high thermal reversible performance and high thermal sublimation dye acceptability performance. Vinyl chloride resin may be used in both a reversible thermal recording layer and a thermal sublimation dye accepting layer and therefore, is extremely excellent resin.

Table 1 below shows the thermal recording performance and thermal sublimation dye acceptability performance of each resin. As shown in Table 1, vinyl chloride resin which is excellent in the above-described both performances is preferably used as a main component of a resin base substrate of a recording layer.

TABLE 1

| Polymer Name | Trade Name | Thermal reversible performance | Thermal Sublimation dye acceptability performance |
|---|---|---|---|
| Vinyl chloride resin | Aldrich reagent & Polyvinyl chloride | 0 | ◎ |
| Polyvinyl chloride acetate copolymer | VYHH manufactured by Union Carbide | ◎ | ◎ |
| Chlorinated vinyl chloride resin | H-428 manufactured by Kanegafuchi Chemical Industry | ◎ | ◎ |
| Phenoxy resin | — | 0 | Δ |
| Polycarbonate | Banraito 1225 manufactured by Teijin | Δ | Δ |
| Polystyrene | SAN-L manufactured by Mitsubishi Monsanto Chemical Company | x | Δ |
| Silicone resin | — | Δ | x |
| Acrylic resin | BR-85 manufactured by Mitsubishi Rayon | x | x |
| Polyamide | CM-8000 manufactured by Toray Industries | x | x |
| Polyvinyl butyral | BX-1 manufactured by Sekisui Chemical | x | Δ |
| Cellulose acetate butyrate | CAB 551-0.01 manufactured by Eastman Kodak | x | x |
| Epoxy resin | Epicoat 1069 manufactured by Petrochemical Shell | 0 | Δ |
| Polyester resin | Y200 manufactured by Toyobo | 0~Δ | ◎ |
| Acetal resin (vinyl acetate resin) | EL-3 manufactured by Sekisui Chemical | x | x |
| Polyvinylidene chloride | F-216 manufactured by Asahi Dow | x | 0 |
| Polyurethane resin | P22S manufactured by Nippon Polyurethane | x | ◎ |
| Ethyl cellulose | Reagent | x | Δ |

The principle by which a reversible thermal recording layer of an information recording medium functions according to the invention is based on a reversible change of transparency of either transparent or white opaque conditions which is engendered by temperature as described above and set forth in FIG. 1. The difference between white opaque and transparent conditions can be presumed as follows:

(I) In the case of a white opaque condition, a thermal recording layer appears white in color because each particle of an organic low molecular weight substance is constituted by a polycrystalline substance in which minute crystals of an organic low molecular weight substance are gathered, and light incident from one side is refracted many times at interfaces between crystals of a particle of an organic low molecular weight substance and is therefore diffused because a crystal axis of an individual crystal is directed in various directions.

(II) In the case of a transparent condition, a thermal recording layer appears transparent because a particle of an organic low molecular weight substance dispersed in a resin base substrate of the recording layer is a large particle of an organic low molecular weight substance, and light incident from one side of a thermal recording layer is transmitted to the other side without being diffused by the particle.

Figure 1:
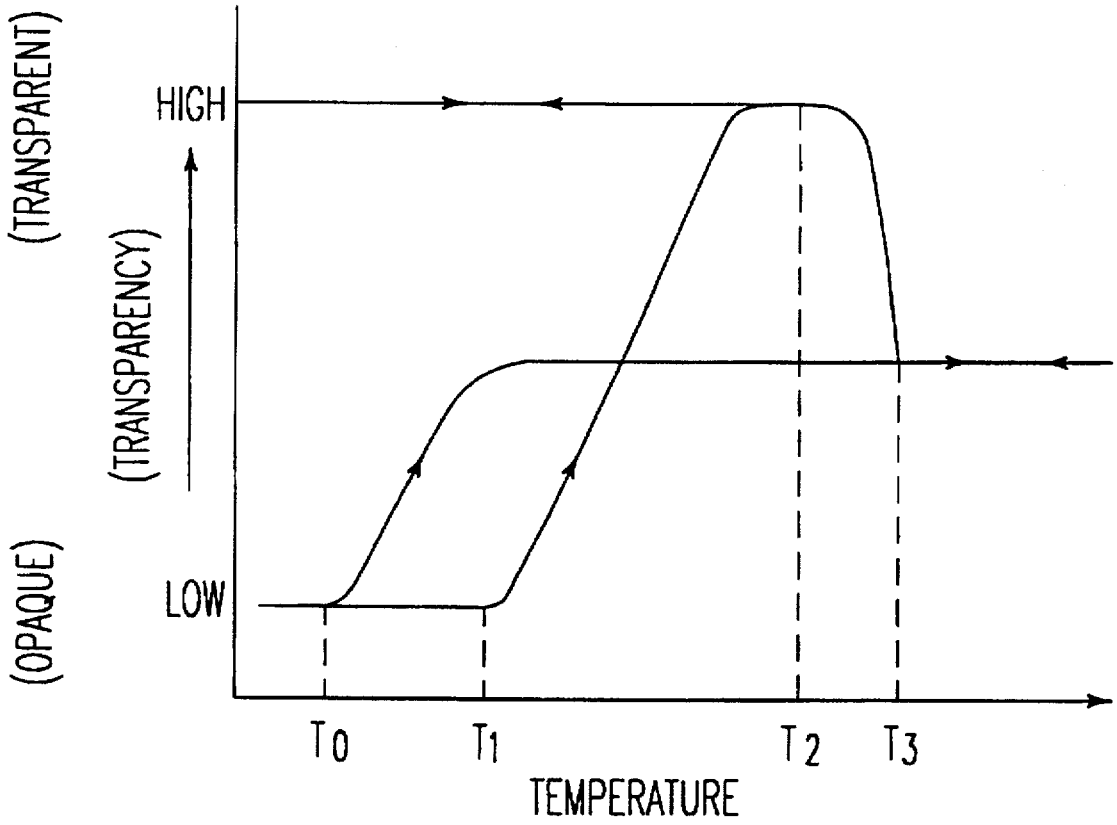
FIG. 1 is a graph depicting the change in transparency caused by heating the reversible thermal recording material as used in the invention.

Referring to FIG. 1 which shows the change of transparency caused by heat, a resin base substrate and a thermal layer mainly comprising organic low molecular weight substances diffused in the resin base substrate are in a white opaque condition at ordinary temperature, for example lower than $T_0$. When they are heated to temperature $T_2$, they become transparent and they remain transparent even if they are cooled to a temperature lower than $T_0$. It is theorized that an organic low molecular weight substance grows from a polycrystal one to a single crystal of one through a half fused condition while the temperature is cooled from $T_2$ to $T_0$ or lower.

When a base substrate and a thermal layer are heated further to temperature $T_3$ or higher, a temperature higher than $T_2$, they become translucent, a condition between maximum transparency and maximum opacity. Next, as their temperature is lowered, they return to the first white opaque condition without becoming transparent again. It is theorized that a polycrystal is crystallized when an organic low molecular weight substance is cooled after being fused at temperature $T_3$ or higher.

If a base substrate and a thermal layer in an opaque condition are cooled to ordinary temperature, that is, to temperature $T_0$ or lower after being heated to temperature between $T_1$ and $T_2$, they can be in a translucent condition between transparent and opaque conditions. If they changed into a transparent condition at ordinary temperature as described above are returned to ordinary temperature after again heated to temperature $T_3$ or higher, they return to a white opaque condition again. That is, they can be in both transparent and opaque conditions and in the intermediate condition at ordinary temperature.

A reversible thermal layer of an information recording medium according to the invention can be formed generally (1) by applying to the surface of the target a solution in which a particulate of an organic low molecular weight substance is dispersed either in a solution in which two components of a resin base substrate and an organic low molecular weight substance are dissolved or a solution of a resin base substrate (use a solvent which does not dissolve an organic low molecular weight substance), and drying the surface, or (2) by kneading the above-described resin and organic low molecular weight components using a solvent or without using it, heating them if necessary and forming the kneaded mixture in the shape of a sheet so that it becomes a thermal recording sheet.

For a solvent for forming a thermal recording material, a variety of substances such as tetrahydrofuran, methyl ethyl ketone, methyl isobutyl ketone, chloroform, carbon tetrachloride, ethanol, toluene and benzene can be selected depending upon the type of resin base substrate and organic low molecular weight substance used. If a dispersed solution is used, it is natural, however, if a solution is used, an organic low molecular weight substance is also crystallized as a particulate in a thermal layer and dispersed.

A resin base substrate used for a thermal layer is required to form a layer in which a dispersed organic low molecular weight substance is uniformly included, to be material which has an effect upon transparency when the thermal layer is most transparent, and what is more important, to be material with good dyeing property of sublimation dye. Therefore, for a resin base substrate, a resin with high transparency, stable mechanical operability, excellent film forming property and good dyeing property of sublimation dye is preferred.

A vinyl chloride resin such as polyvinyl chloride, a polyvinyl chloride acetate copolymer, a copolymer of vinyl chloride, vinyl acetate and vinyl alcohol, a copolymer of vinyl chloride, vinyl acetate and maleic acid, and a copolymer of vinyl chloride and acrylate is the most suitable for use as the resin base substrate. In addition, a copolymer of vinylidene chloride such as polyvinylidene chloride, a copolymer of vinylidene chloride and vinyl chloride, a copolymer of vinylidene chloride and acrylonitrile, polyester, polyamide, a copolymer of polyacrylate or polymethacrylate or acrylate and methacrylate and silicone resin can also be used. The above resin may be used individually or as mixtures of two or more.

As an organic low molecular weight substance, any substance that changes from a polycrystal to a single crystal in a recording layer by heating is preferable, an organic low molecular weight substance of melting point generally 30° to 200° C. and preferably approximately 50° to 150° C. is preferred. For such an organic low molecular weight substance, alkanol; alkanethiol; alkanol halide or alkanethiol halide; alkylamine; alkane; alkene; alkyne; alkane halide; alkene halide; alkyne halide; cycloalkane; cycloalkene; cycloalkyne; saturated or unsaturated mono- or dicarboxylic acid, or such carboxylic ester, such carboxylic amide or such carboxylic ammonium salt; saturated or unsaturated fatty acid halide, or such fatty ester, such fatty amide or such fatty ammonium salt; allylcarboxylic acid or allylcarboxylic ester, allylcarboxylic amide or allylcarboxylic ammonium salt; allylcarboxylic acid halide, or allylcarboxylic ester halide, allylcarboxylic amide halide or allylcarboxylic ammonium salt halide; thioalcohol; thiocarboxylic acid, or thiocarboxylic ester, thiocarboxylic amide or thiocarboxylic ammonium salt; carboxylic ester of thioalcohol can be given as an example. These are used individually and two types or more of them are used together. Such a compound includes 10 to 60 carbon atoms. It is preferred that the organic low-molecular weight substance be a compound having 10 to 38 carbon atoms, more preferably 10 to 30 carbon atoms. The alcohol used to form esters may be saturated or unsaturated and may be halogenated. In any case, it is preferable that an organic low molecular weight substance is a compound including at least one of oxygen, nitrogen, sulfur and halogen in a molecule, for example —OH, —COOH, —CONH—COOR, —NH—, —$NH_2$, —S—, —S—S—, —O— and halogen.

Specific compounds suitable for use as the organic low molecular weight substance are higher fatty acids such as lauric acid, dodecanoic acid, myristic acid, pentadecenoic acid, palmitic acid, stearic acid, behenic acid, nonadecanoic acid, alginic acid and oleic acid, higher fatty ester such as methyl stearate, tetradecyl stearate, octadecyl stearate, octadecyl laurate, tetradecyl palmitate and dodecyl behenate, and ethers or thioethers as follows can be given as an example:

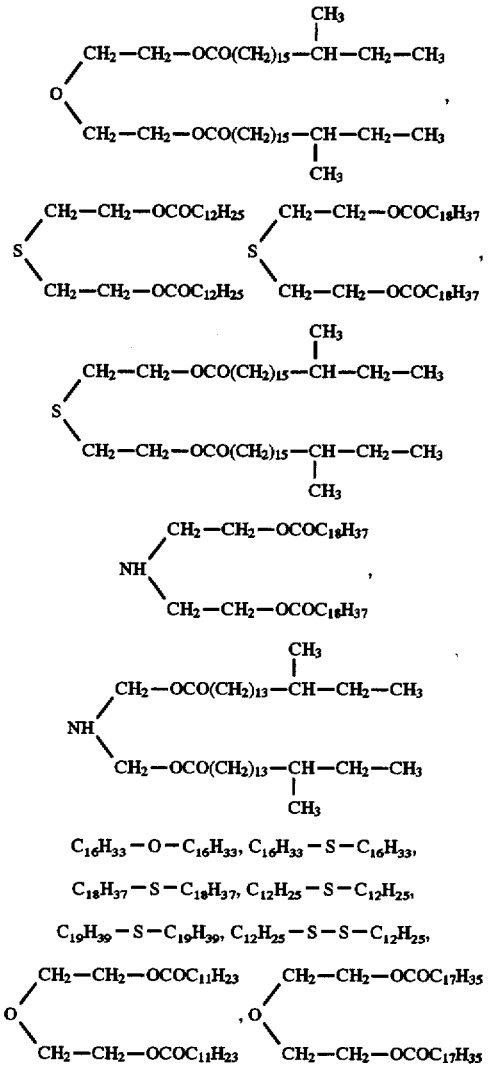

Higher fatty acids are most useful, especially higher fatty acid including 16 carbon atoms or more such as palmitic acid, stearic acid, behenic acid and lignoceric acid. Most preferable are higher fatty acids including 16 to 24 carbon atoms.

It is preferable that the ratio of an organic low molecular weight substance and a resin base substrate in a thermal layer should be approximately 2:1 to 1:16 in ratio by weight, and it is further preferable that the ratio should be 1:1 to 1:5. If the ratio of a resin base substrate is smaller, forming a film comprising organic low molecular weight substances in a resin base material is difficult, and if the ratio is larger, opaquing is difficult because an amount of organic low molecular weight substances available to cause the opaque effect is less.

An additive such as a surface-active agent and retarder thinner can be added to a thermal recording layer so as to facilitate forming a transparent image in addition to the above-described components. Suitable additives are as follows:

Example of retarder thinner:

Tributyl phosphate, tri-2-ethelhexyl phosphate, triphenyl phosphate, tricresyl phosphate, butyl oleate, dimethyl phthalate, diethyl phthalate, dibutyl phthalate, diheptyl phthalate, di-n-octyl phthalate, di-n-ethelhexyl phthalate, diisononyl phthalate, dioctyl decyl phthalate, diisodecyl phthalate, butyl benzyl phthalate, dibutyl adipate, di-n-hexyl adipate, di-2-ethylhexyl adipate, alkyl adipate 610, di-2-ethylhexyl azelate, dibutyl sebacate, di-2-ethylhexyl sebacate, diethylene glycol dibenzoate, triethylene glycol di-2-ethylbutyrate, methyl acetyl ricinoleate, butyl acetyl ricinoleate, butyl phthalyl butyl glycolate, tributyl acetyl citrate.

Examples of a surface-active agents and other additives:

Polyalcohol higher fatty ester; polyalcohol higher alkyl ether; polyalcohol higher fatty ester, higher alcohol, higher alkyl phenol, higher fatty higher alkylamine, higher fatty amide, lower olefin oxide adduct of fats and oils or polypropylene glycol; acetylene glycol; Na, Ca, Ba or magnesium salt of higher alkylbenzene sulfonates; higher fatty acid, aromatic carboxylic acid, higher fatty sulfonic acid, aromatic sulfonic acid, Ca, Ba or magnesium salt of monoester sulfate, or mono- or diester phosphate; low sulfonated oil, chained polyalkylacrylate; acrylic oligomer; chained polyalkylmethacrylate; copolymer of chained alkylmethacrylate and monomer including amine; copolymer of styrene and maleic anhydride; copolymer of olefin and maleic anhydride A parting agent such.as amino denatured silicone, epoxy denatured silicone and alkyd denatured silicone can be included in a thermal recording layer according to the invention.

A filler can be also included in a thermal recording layer. For a filler, white pigment such as silica, titanium oxide and calcium carbonate can be given. In addition, a surface-active agent, an absorbent of ultraviolet rays or an antioxidant may be included in a thermal recording layer appropriately.

In addition, a layer including the above-described parting agent may be provided on a thermal recording layer or designs and characters may be printed.

For material for a parting agent layer 0.1 to 5 μm thick laminated on a thermal, recording layer, the above-described silicone is used as a parting agent, and silicone rubber, silicone resin disclosed in Published unexamined patent application No. S63-221087, polysiloxane graft polymer disclosed in Published unexamined patent application No. S62-152550, and ultraviolet curing resin or electron beam curing resin disclosed in Published unexamined patent application No. S63-310600 are used as a binder for producing an effect of protection from heat. In any case, a solvent is used when any of the above-described is applied and referring to such a solvent, a solvent which hardly dissolves the resin and organic low molecular weight substance is preferable.

For a solvent which hardly dissolves resin and an organic low molecular weight substance included in a thermal recording layer, n-hexane, methyl alcohol, ethyl alcohol and isopropyl alcohol can be given. An alcohol solvent is particularly preferable in view of costs.

A method for forming other layers of an information recording medium according to the invention is as follows:

A transfer accepting layer is formed by resin with a dyeing property and if necessary, it may be formed in two layers or more.

For resin used for a transfer accepting layer, a resin with a dyeing property is used. The specific type of resin is not limited, however, polyester, polyvinyl chloride and a polyvinyl chloride acetate copolymer are especially preferable.

A dyed layer (4) may be formed by applying a dispersion or solution mainly comprising dye and a resin binder on a target surface and then drying the applied surface, or by sticking a dyed sheet on the surface. Dye is required to have change of transparency and white opacity of a reversible thermal recording layer which is the upper layer of a dyed layer recognized as a reflected image, and dye, pigment or metal powder with a dye which reflects light such as red, yellow, blue, dark blue, purple, black, brown, grey, orange, green, silver and gold is used. For a resin binder, thermoplastic resin, thermosetting resin or ultraviolet setting resin is used.

A light reflecting layer (5) may be formed an a base substrate (1) by depositing aluminum using vacuum deposition or other standardized techniques, e.g., sputtering. The above-described dyed layer (46) and light reflecting layer (5) help improve the visibility of a displayed image formed on a reversible thermal recording layer.

Next, a magnetic layer is formed by depositing magnetic material on a target surface by vacuum evaporation, sputtering slid so on, or by applying magnetic material together with a resin binder and drying them. For magnetic material, iron, cobalt, nickel, their alloy and compound can be given. For a resin binder, thermoplastic resin, thermosetting resin or ultraviolet setting resin can be given as for a dyed layer. If necessary, a masking layer may be provided on a magnetic layer, or designs and characters can be printed on a magnetic layer.

Further, a protective layer or a parting agent layer and an intermediate, layer between either of the above-described layers and a thermal recording layer may be provided as disclosed in Published unexamined patent application No. Hl-133781 so as to protect a thermal recording layer from protective layer forming solution, a solvent for parting agent layer forming solution or a monomer component. For material for an intermediate layer, thermosetting resin and thermoplastic resin as follows may be used in addition to the above-described as resin material in a thermal recording layer: polyethylene, polypropylene, polystyrene, polyvinyl alcohol, polyvinyl butyral, polyurethane, saturated polyester, unsaturated polyester, epoxy resin, phenol resin, polycarbonate and polyamide. It is preferable that the thickness of the above-described intermediate layer is approximately 0.1 to 2 μm.

For a base substrate (1), a transparent or white plastic film such as a polyester film, paper, dyed film or paper is used.

Figure 8:
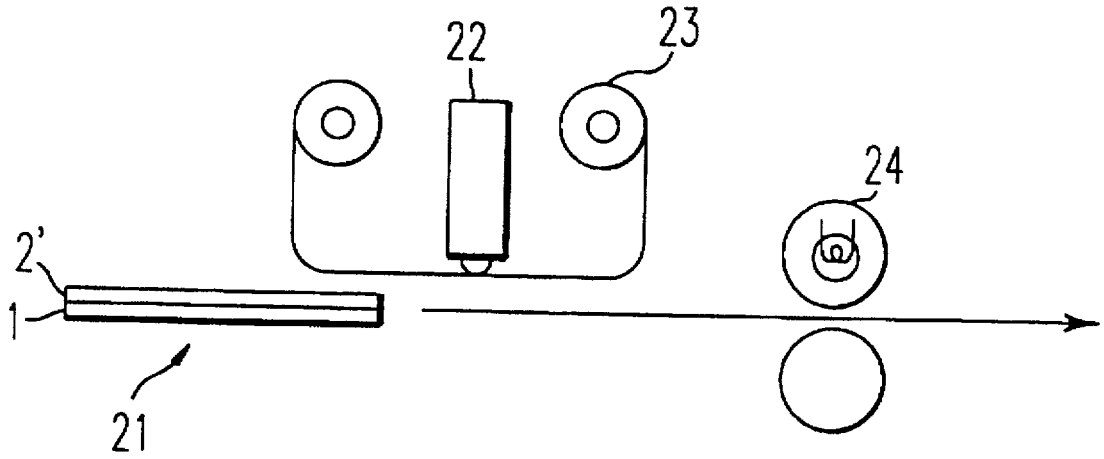
FIG. 8 is a schematic drawing showing an outline of a thermal recording method according to the invention.
Figure 9:
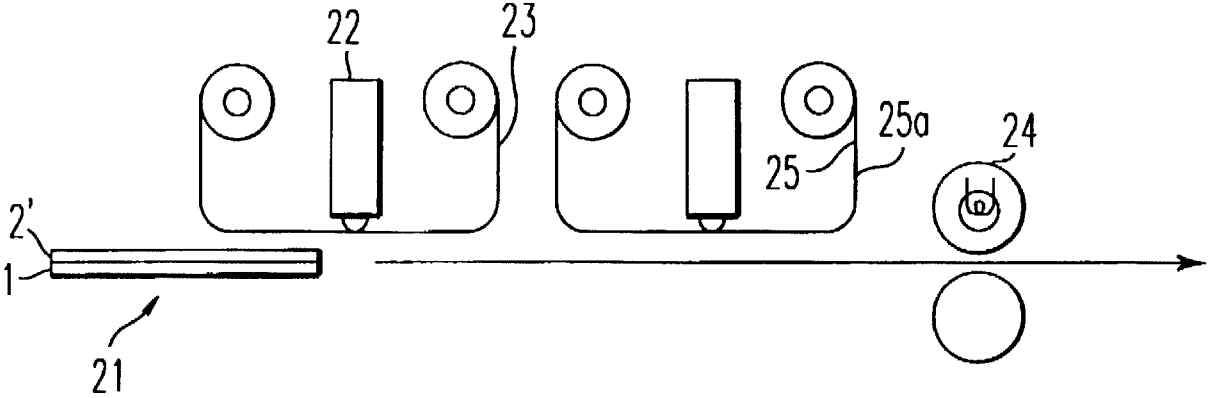
FIG. 9 is a schematic drawing showing an outline of another thermal recording method according to the invention.
Figure 10:
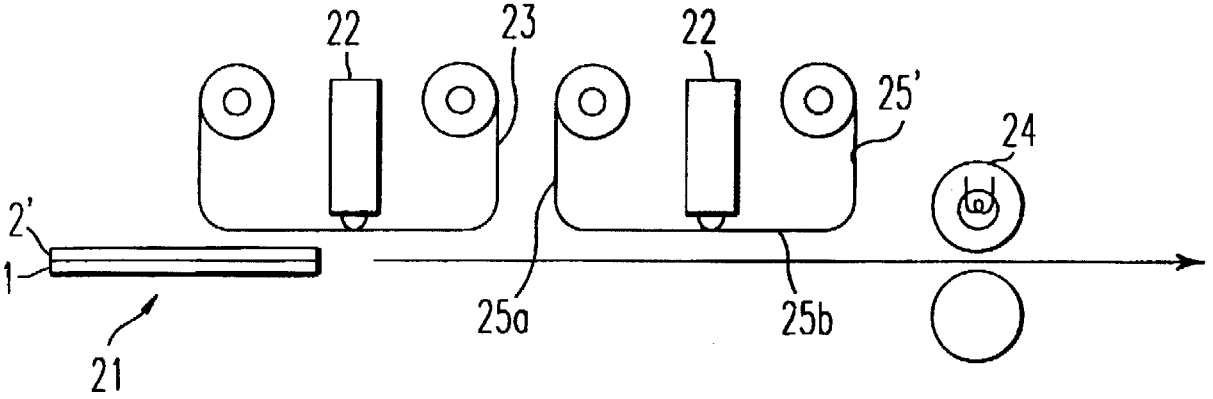
FIG. 10 is a schematic drawing showing an outline of the other thermal recording method according to the invention.

FIGS. 8 to 10 are schematic drawings showing a typical outline of a thermal recording method respectively according to the invention.

Figure 11:
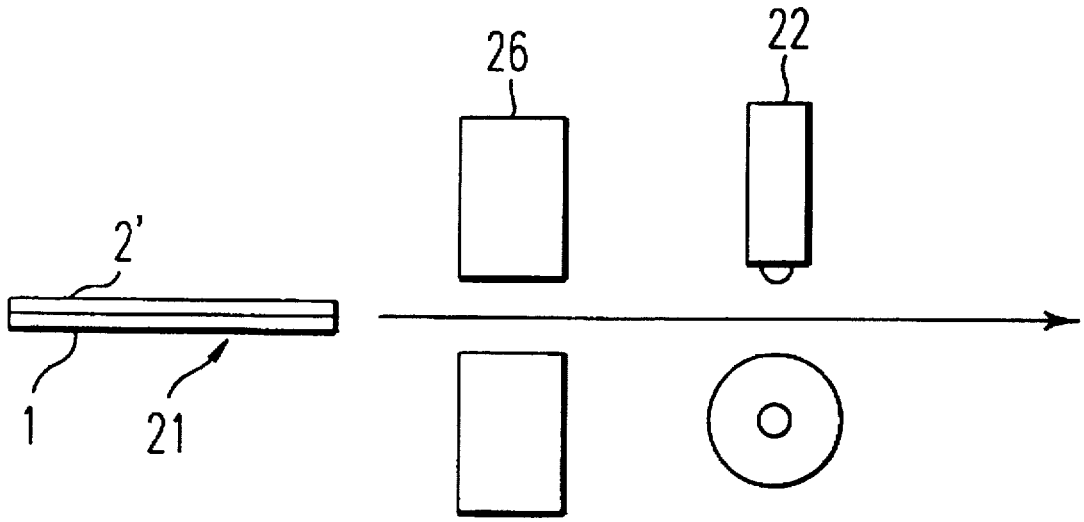
FIG. 11 is a schematic drawing showing a recording/erasing apparatus according to a thermal recording method.

FIG. 11 is a schematic drawing showing a typical recording/erasing device by a thermal recording method.

Thermal recording methods shown in FIGS. 8 to 10 according to the invention are used for example, in a system of employing rewritable ID card with a picture of a person's face, a sublimation dye image may be transferred without a uneven portion. Further a sublimation dye image to be transferred is fixed and fixing of an image can be also enhanced.

The process will be described in detail below. If for example, he thermal recording medium is used as a point card, in a first step, both a picture of a customer's face (a sublimation dye image to be transferred) read from a scanner and a video, and fixed information such as a customer's name and member number if desired are printed by thermal recording methods shown in FIGS. 8 to 10. At least a portion which corresponds to a thermal recording layer in a portion in which a transferred sublimation dye image is formed is heated by a heating member. The rewritable ID card with a picture of the customer's face in this condition is handed to the customer.

In a second step, when a point of a customer is to be added, the rewritable ID card is received from the customer, the point shown in the form of a number, language or an image and other information such as date and a message are recorded in the thermal recording layer portion in which transparency is reversible depending upon temperature by a thermal, recording method shown in FIG. 11, and the ID card is returned to the customer. Printing and erasing in the second step are repeated.

At this time, if printing in a reversible thermal recording layer 2' is performed on a dyed layer or a light reflecting layer, an image is clear.

For a method for heating after a sublimation image is formed, it is preferable that the entire medium is in contact by a heating roller or a heater bar rather then hot stamper because a sublimation image formed portion may be formed on the approximately entire surface. If the entire surface is heated by a hot stamper, the area must be large, a large-sized device is required and the cost is increased.

To remove an opaque or transparent uneven portion and meet fixing of a sublimation image, it is preferable that a sublimation image is heated for one second or more in case a hot stamper is used and for 20 mm/sec. or less in carriage speed in case a heating roller or a heater bar is used.

After a thermal sublimation dye image to be transferred is formed, an overcoat layer may be formed on the surface.

An overcoat layer is formed by a compound of transparent resin and wax.

For above-described transparent resin, polyester resin, polystyrene resin, acrylic resin, epoxy resin, cellulosic resin, polyvinyl acetal resin, and copolymerized resin of vinyl chloride and vinyl acetate can be given. These resins are excellent in transparency, however, as they have a tendency to form relatively stiff films, the depth of cut into film in transferring is not sufficient, film is often damaged by surface friction because slippage is not sufficient, and as a result gloss of film is often deteriorated. The depth of cut into film in transferring and slippage become sufficient by mixing wax with such transparent resin according to the invention.

For a typical example of wax used according to the invention, microcrystalline wax, carnauba wax and paraffin wax can be given. In addition, a variety of wax such as Fischer-Tropsch wax, low molecular weight polyethylene, haze wax, beeswax, spermaceti wax, Chinese wax, wool grease, shellac wax, candelilla wax, petrolatum, one-part denatured wax, fatty ester, fatty amide is used.

It is preferable that the used amount of the above-described wax is in the ratio of 0.5 to 20 parts by weight per 100 parts by weight of the above-described transparent resin, and it is not preferable that if the used amount of wax is too little, the depth of cut into a line in transferring and antifriction of the transferred film are insufficient and that in the meantime if it is too much, the durability and transparency of transferred film are insufficient.

For a mixing method of the above-described transparent resin and wax, a method in which both are mixed by fusing them and a method in which both are mixed by fusing them in an appropriate organic solvent can be given, however, the mixing method is not limited.

It is especially preferable that transparent resin is used in the condition of its dispersed or emulsified solution, that in the meantime wax is used in the condition of its solution, or dispersed or emulsified solution, and that both are mixed. After they are coated on base film using such each dispersed or emulsified solutions, film is formed by drying it at relatively low temperature so that at least a part of their resin particles are left. Extremely a part of the surface of the film formed as described above is opaque in white because resin particles are left, however, the cross section is smoothed by heat and pressure in transferring by heat and transfer can be performed on the film as transparent film.

For a method in which an overcoat layer is formed on base film or on a parting layer beforehand provided on it, a method in which ink comprising the above-described resin and wax is applied and dried by many means such as gravure coating, gravure reverse coating and roll coating can be given. If a transparent resin layer is formed by a compound dispersed solution of resin and wax, it is preferable that a coated solution is dried at the temperature lower than a melting point of a resin particle, for example at the relatively low temperature approximately 50° to 100° C. The depth of cut into film in transferring is remarkably increased by drying it at such temperature because film is shrunk with resin particles left and slippage of transferred film is kept.

Referring to forming the above-described transparent resin layer, gloss, resistance to light and heat, and white opacity of coated various dyed images can be kept by including lubricant, ultraviolet absorbent, and an additive such as antioxidant and/or an optical whitening agent.

It is preferable that prior to forming the above-described transparent resin layer, a parting layer is formed on the surface of base film. Such a parting layer is formed by a release agent such as a variety of wax described above, silicone wax, silicone resin, fluorine contained resin and acryl resin. The forming method may be similar to that of the above-described transparent resin layer and approximately 0.5 to 5 μm is sufficient for the thickness. In case a mat protective layer against a transferring device is desired, the surface of parting layer can be matted by including various typos of particles in the parting layer or by using bass film of which parting controlled surface is matted.

Further, a thermal adhesive layer may be provided on the surface of the above-described transparent resin layer so as to enhance a transferring property of the transparent resin layer. It is preferable that such a thermal adhesive layer is formed approximately 0.5 to 10 μm thick by applying and drying solution of resin with good a thermal adhesive property such as acryl resin, vinyl chloride resin a polyvinyl chloride acetate copolymer and polyester resin.

To enhance repeatability of printing and erasing by a thermal recording method according to the invention, it is preferable that thermoplastic resin, thermosetting resin and bridged resin such as UV and EB are used for transparent film forming an overcoat layer.

For thermoplastic resin, copolymerized resin of ethylene and vinyl chloride, a copolymer of ethylene and vinyl acetate, graft polymerized resin of ethylene, vinyl acetate and vinyl chloride, vinylidene chloride resin, vinyl chloride resin, chlorinated vinyl chloride resin, chlorinated polyethylene, chlorinated polypropylene, vinyl acetate resin, phenoxy resin, butadiene resin, fluorine contained resin, polyamide, polyamide imide, polyarylate, thermoplastic polyimide, polyether imide, polyether ketone, polyethylene, polyethylene oxide, polycarbonate, polystyrene, polysulfone, poly-p-methylstyrene, polyarylamine, polyvinyl alcohol, polyvinyl ether, polyvinyl butyral, polyvinyl formal, polyphenylene ether, polypropylene, polymethyl pentene, methacrylate resin and acrylate resin can be given.

For thermosetting resin, epoxy resin, xylene resin, guanamine resin, diallyl phthalate resin, vinyl ester resin, phenol resin, unsaturated polyester resin, fran resin, polyimide resin, polyurethane resin, maleic resin, melamine resin and urea resin can be given.

Each resin described-above may be copolymerized and two types or more of resins may be compounded. A functional group such as a hydroxyl group and a carboxyl group may be added to such resin if necessary and such added resin may be bridged by heat, ultraviolet rays or electron beams using a crosslinking agent. In case. such resin is bridged by ultraviolet rays, a photopolymerization initiator such as benzophenone is further used.

For a cross linking agent, isocyanate and acrylate monomers as follows can be given:

Hexanediol diacrylate (HDDA), neopentyl glycol diacrylate (NPGDA), diethylene glycol diacrylate (DEGDA), tripropylene glycol diacrylate (TPGDA), polyethylene glycol diacrylate (PEG 400DA), hydroxy pivalic neopentyl glycol (MANDA)(HPNDA), diacrylate of neopentyl glycol adipate diacrylate of ε-caprolactam adduct of hydroxy pivalic neopentyl glycol, 2-(2-hydroxy-1, 1-dimethyl ethyl)-5-hydroxymethyl-5-ethyl-1, 3-dioxane diacrylate, tricyclodecane dimethylol diacrylate, ε-caprolactam adduct of tricyclodecane dimethylol diacrylate, diacrylate of diglycyl ether of 1- or 6-hexanediol, trimethylol propane triacrylate (TMPTA), propionic dipentaerythritol triacrylate, hydroxy pivalic aldehyde denatured dimethylol propane triacrylate, tetraacrylate of dipentaerythritol propionate, ditrimethylol, propane tetraacrylate, pentaacrylate of dipentaprythritol propionate, dipentaerythritol hexaaarylate (DPHA), ε-caprolactam adduct of DPHA (DPCA-20), ε-caprolactam adduct of DPHA (DPCA-30), εcaprolactam adduct of DPHA (DPCA-60), diacrylate of propylene oxide adduct of neopentyl glycol, diacrylate of ethylene oxide adduct of hydroxy pivalic neopentyl glycol, triacrylate of propylene oxide adduct of trimethylol, propane, triacrylate of fatty ester of penterythritol, pentaacrylate of 1- or 3-dioxanpentanol, hexaacrylate of ε-caprolactam adduct of dipentaerythritol, diacrylate of ε-caprolactam adduct of hydroxy pivalic neopentyl glycol, diacrylate of ε-caprolactam adduct of tricyclodecane dimethylol.

An overcoat may be formed by bridging using a prepolymer and a cross linking agent in addition to the above-described method. For a prepolymer, polyurethane acrylate, polyepoxy acrylate, polyol can be given and for a cross linking agent, the above-described acrylate monomer is used. These are bridged by electron beams or ultraviolet rays. In case ultraviolet rays are used, the above-described photopolymerization initiator or a sensitizer may be used.

A monofunctional acrylate monomer may be added as reactive diluent so as to adjust viscosity of applied liquid.

Embodiments

The invention will be described further in detail based upon embodiments below, however, the invention is not limited to the embodiments. A part and % as follows are both criteria of weight.

First Embodiment

Aluminum is deposited on one surface of white polyester film 250 μm thick under vacuum deposition conditions to be a dyed layer. Next, solution comprising the following is applied on this dyed layer.

Behenic acid manufactured by Miyoshi Fats & Oils: 5 parts

Dieicosanoic acid, SL-90 manufactured by Okamura Oil: 5 parts

Diethyl hexyl phthalate: 3 parts

Polyvinyl chloride acetate copolymer, VYHH manufactured by UCC: 40 parts

Amino denatured silicone resin, SF8417 manufactured by Toray Silicone: 2 parts

Tetrahydrofuran, THF: 200 parts

The layer is dried to provide a transparent thermal sublimation transfer receiving and reversible thermal recording layer 15 μm thick, so as to form an information recording medium:

A clear full-dyed image is formed on the thermal recording layer by thermal sublimation printing using a device shown in FIG. 8. The device uses a commercial thermal sublimation transferring ribbon manufactured by Dai Nippon Printing Co., Ltd. Next, a clear full-dyed image without white opaque unevenness is formed on the portion covering the aluminum deposited layer by closely passing a roller heated at 90° C.±5° C., which is in the range of transparentizing temperatures, at a carriage speed of 10 mm/sec. Referring to opaque unevenness, as a result of measuring the density of, a transparent background in the five positions of 1.05, 1.10, 1.08, 1.13 and 1.07 with a Macbeth densitometer, the density was in the range of ±20%. When the above-described sublimation image was left at the temperature of 40° C. and humidity of 90% for two days, the density of the image was almost similar.

Second Embodiment

The medium according to the first embodiment is put in a thermostatic oven 110° C. for three minutes after drying, and the completely white opaque medium is used as an information recording medium. A full-dyed image is formed as in the first embodiment and next, a clear full-dyed image is formed on the white surface by closely passing a roller-heated at 115° C.±5° C. in the range of opacifying temperatures at a carriage speed of 15 mm/sec. As a result of measuring the density of an opaque background in the five positions of 0.22, 0.25, 0.23, 0.23 and 0.22 with Macbeth densitometer, the density was in the range of ±20% and was almost similar even when left at the temperature of 40° C. and the humidity of 90% for two days.

Third Embodiment

After a full-dyed image is formed on the information recording medium according to the first embodiment, as in the first embodiment, using a device shown in FIG. 9, an overcoat layer is formed on the above-described medium using a thermal transfer ribbon on the market manufactured by Dai Nippon Printing Co., Ltd. for an overcoat on the market, and next, a clear full-dyed image without white opaque unevenness is formed on an aluminum deposited layer by closely passing a roller heated at 90° C.±5° in the range of transparentizing temperatures at a carriage speed of 10 mm/sec. The density of a transparent background measured in the five positions of 1.08, 1.12, 1.10, 1.10 and 1.15 was in the range of ±20. Even when the above-described sublimation image was left at the temperature of 40° C. and the humidity of 90% for two days, the density of the image was similar. Moreover, fixing of a sublimation image is increased by providing an overcoat layer.

Fourth Embodiment

After a full-dyed image is formed as in the third embodiment using a device shown in FIG. 10, a clear character image by a thermally fused image to be transferred and a clear full-dyed image are formed on an aluminum deposited layer by the same method as described above except that a thermally fused image is formed before an overcoat layer is formed. Evenness of an opaque uneven portion and fixing of a sublimation image measured in the five positions of 1.10, 1.11, 1.12, 1.15 and 1.09 at that time are similar to the result in the third embodiment.

Fifth Embodiment

A clear full-dyed image is formed on the white surface by the same method as described above except that the information recording medium is completely opacified in white as in the second embodiment and a roller heated at 115° C.±5° C. in the range of white opacifying temperatures is closely passed as in the third embodiment. Evenness of an opaque uneven portion and fixing of a sublimation image measured in the five positions of 0.24, 0.25, 0.23, 0.25, 0.25 at that time are similar to the result of the third embodiment.

Sixth Embodiment

A clear character image and a clear full-dyed image are formed on the white surface by the same method as described above, except that the information recording medium is completely opacified in white as in the second embodiment and a roller heated at 115° C.±5° C. in the range of white opacifying temperatures is closely passed as in the fourth embodiment. Evenness of an opaque uneven portion and fixing of a sublimation image measured in the five positions of 0.25, 0.26, 0.23, 0.23, 0.23 at that time are similar to the result of the third embodiment.

Seventh Embodiment

A device shown in FIG. 11 is used on a full-dyed image formed according to the first to the sixth embodiments, and no erasing device is used, a white opaque image or character is formed on the transparent surface by printing energy of 0.18 mJ/dot, and a transparent image or character is formed on the white surface by printing energy of 0.1 mJ/dot.

Eighth Embodiment

Even if printing a white opaque or transparent image on the medium according to the first to the sixth embodiments as in the seventh embodiment using a device shown in FIG. 11 and erasing are repeated 100 times, performance of a white opaque image is hardly deteriorated.

As the description of the embodiments clarifies, a clear image without an opaque uneven portion is formed according to a thermal recording method of the invention and further, a white opaque image, a transparent image, a character image and a full-dyed image can be formed. A sublimation dye image is fixed by heating and fixation of the image is increased. Furthermore, durable recording by heat reversible repetition is enabled by providing an overcoat layer on a sublimation dye image to be transferred.

This application is based on and claims priority of Japanese patent application no: P6-303092, filed Nov. 11, 1994, the entire disclosure of which is hereby incorporated herein by reference.

What is claimed as new and desired to be secured by Letters Patent of the United States is:

1. Thermal recording medium, comprising:

a base substrate;

a thermal recording layer, the transparency of which is reversibly changeable depending on the temperature to which said thermal recording layer is exposed, said thermal recording layer also having a function of accepting a thermal sublimation dye;

a sublimation dye image formed on said thermal recording layer, at least a portion of said thermal recording layer on which said sublimation dye image is formed having been heated.

2. Thermal recording medium according to claim 1, wherein an overcoat layer is superimposed on said thermal sublimation dye image.

3. Thermal recording medium according to claim 2, wherein said overcoat layer is formed by a thermal transfer recording method.

4. Thermal recording medium according to claim 1, further comprising a thermally fused image formed on said recording medium after said sublimation image is formed.

5. Thermal recording medium according to claim 1, wherein said reversibly changeable thermal recording layer has been made transparent by heating said layer at a temperature in the range of transparentizing temperatures.

6. Thermal recording medium according to claim 1, wherein said reversibly changeable thermal recording layer has been opacified by heating said layer at a temperature in the range of white opacifying temperatures.

7. Thermal recording medium according to claim 1, wherein a white opaque image or a transparent image has been printed by direct heating of the thermal recording medium.

8. Thermal recording medium according to claim 7, wherein printing of said white opaque image or transparent image by heating and erasing said image have been repeated.

9. A thermal recording medium as set forth in claim 1 wherein a portion of the thermal recording medium corresponding to the thermal recording layer on which the thermal sublimation image is formed is substantially even in transparency.

10. A method of thermal recording comprising the steps of:

forming a base substrate;

forming a thermal recording layer, the transparency of which is reversibly changeable depending on the temperature to which said thermal recording layer is heated, said thermal recording layer also having a function of accepting a thermal sublimation dye;

forming a sublimation dye image by image-wise sublimation of a dye on said thermal recording medium; and heating at least that portion of said thermal recording layer corresponding to said sublimation dye image.

11. A method of thermal recording according to claim 10, further comprising a step of providing an overcoat layer after formation of said thermal sublimation dye image.

12. A method of thermal recording according to claim 11, wherein said overcoat layer is formed by a thermal transfer method.

13. A method of thermal recording according to claim 10, wherein a thermally fused image is formed or said thermal recording layer after said sublimation image is formed.

14. A method of thermal recording according to claim 10, further comprising a step of heating the thermal recording medium to its transparentizing temperature.

15. A method of thermal recording according to claim 10, further comprising heating the thermal recording medium to its white opacifying temperature.

16. A method of thermal recording according to claim 10, further comprising a step of printing a white opaque image or a transparent image by directly heating said thermal recording layer of the thermal recording medium.

17. A method of thermal recording according to claim 16, further comprising a step of repeating the operations of printing said white opaque image or transparent image by heating and erasing said images.

18. A method of thermal recording, comprising steps of:

forming a thermal sublimation dye image on at least one surface of a thermal recording layer located on a base substrate, wherein the transparency of said thermal recording layer is reversibly changeable depending on the temperature to which said thermal recording layer is exposed;

heating the imaged recording medium in order to make the thermal sublimation image portion of said thermal recording layer even in transparency.

19. Thermal recording medium, comprising:

a base substrate;

a thermal recording layer, the transparency of which is reversibly changeable depending on the temperature to which said thermal recording layer is exposed, said thermal recording layer being disposed on said base substrate and having a function of accepting a thermal sublimation dye; and a sublimation dye image formed on said thermal recording layer.

* * * * *